US005285943A

United States Patent [19]

Sato

[11] Patent Number: 5,285,943

[45] Date of Patent: Feb. 15, 1994

[54] TAPE FEEDING APPARATUS

[75] Inventor: Koji Sato, Tokyo, Japan

[73] Assignee: Kabushiki Kaisha Shinkawa, Tokyo, Japan

[21] Appl. No.: 913,866

[22] Filed: Jul. 15, 1992

[30] Foreign Application Priority Data

Jul. 15, 1991 [JP] Japan ..... 3-198196

[51] Int. Cl.[5] ..... B65H 20/18

[52] U.S. Cl. ..... 226/149; 226/165

[58] Field of Search ..... 226/199, 150, 162, 165; 352/184, 225

[56] References Cited

U.S. PATENT DOCUMENTS 3,914,035 10/1975 Satterfield ..... 352/225 X
4,522,476 6/1985 Renold ..... 352/225
4,580,710 4/1986 Ledgerwood ..... 226/150 X
5,052,606 10/1991 Cipolla et al. ..... 226/149 X

FOREIGN PATENT DOCUMENTS 2-1372 1/1990 Japan .
2-273949 11/1990 Japan .

*Primary Examiner*—Daniel P. Stodola
*Assistant Examiner*—Paul T. Bowen
*Attorney, Agent, or Firm*—Koda and Androlia

[57] ABSTRACT

In a tape feeding apparatus used in bonding machines for semiconductor devices, both upper and lower tape clampers are driven upward and downward. Thus, during the tape feeding operation, the upper clamper and the lower clamper can be both withdrawn from a tape feeding path so that neither the upper surface nor the under surface of the tape contact the upper clamper nor the lower clamper. No scratches, etc. would occur in the tape. In addition, the bonding level of the tape is determined by the upper surface of the lower clamper during the tape clamping operation, thus securing high bonding precision.

1 Claim, 6 Drawing Sheets

TAPE FEEDING APPARATUS

BACKGROUND OF THE INVENTION

1. Field of the Invention

The present invention relates to a tape feeding apparatus incorporated with a tape clamping mechanism used in, for example, tape bonding machines.

2. Prior Art

In conventional tape clamping mechanisms, an upper clamper (also called the "bonding guide") is positionally fixed, and a bonding tape is clamped by an up and down movement of the lower clamper only. This is described, for example, in Japanese Patent Application Publication (Kokoku) No. 2-1372 and Japanese Patent Application Laid-Open (Kokai) No. 2-273949.

Generally, tab tapes used in the manufacture of semiconductor devices are formed with a copper foil pasted to the surface of a resin tape that has a thickness of approximately 50 to 125 microns. Accordingly, extremely large amounts of warping, torsion and undulation, etc. tend to occur. As a result, in the bonding areas where semiconductor pellets or bumps, etc. are bonded to the tape, it is necessary to apply a certain amount of tension to the tape so that the tape is kept almost flat when the bonding and feeding of the tape are performed.

However, since in the prior art described above the tape is fed with tension applied and is in contact with the upper clamper, rubbing scratches, etc. are occasionally formed on the upper surface of the tape during this feeding operation. In addition, though the upper surfaces of semiconductor pellets or bumps are bonded to the undersurface of the tape, bonding in the prior art is performed with the upper surface of the tape positioned against the undersurface of the upper clamper. In other words, the tape positioning in the prior art is made with reference to the upper surface thereof and not the undersurface. Accordingly, bonding quality tends to be poor.

SUMMARY OF THE INVENTION

One object of the present invention is to provide a tape feeding apparatus which prevents rubbing scratches on the tape surface.

Another object of the present invention is to provide a tape feeding apparatus which prevents rubbing scratches in order to improve the bonding quality.

The first means of the present invention to accomplish the objects is characterized by the fact that in a tape feeding apparatus which includes a tape clamping mechanism for holding a tape with an upper clamper and a lower clamper, the upper and lower clampers are both driven upward and downward.

The second means of the present invention to achieve the objects is characterized by the fact that the upper and lower clampers in the first means are driven by a single driving source.

In addition, the third means of the present invention to achieve the objects is characterized by the fact that the upper and lower clampers in the first means are forcibly raised by cams and lowered by a spring force, and when the tape is going to be held between the clampers, the upper clamper is lowered after the lower clamper has been raised, and when the tape is fed, the lower clamper is lowered after the upper clamper has been raised.

In the first means, the upper and lower clampers are withdrawn from a tape feeding path by driving them up and down during the tape feeding operation. In other words, the upper clamper is raised, and the lower clamper is lowered. As a result, both the upper surface and the under surface of the tape do not contact the upper clamper or lower clamper during the tape feeding operation; and therefore, scratches, etc. on the tape is prevented.

In the second means, the upper and lower clampers are driven by a single driving source. Accordingly, the number of driving parts, etc. used to operate the upper and lower clampers can be reduced, and the manufacturing cost of the apparatus can be low.

In the third means, the lower clamper is forcibly raised by means of cams during the tape clamping operation, thus determining the bonding level. Afterward, the upper clamper is lowered to press the tape against the lower clamper by means of a spring force. Thus, the bonding level of the tape can be determined with reference to the upper surface of the lower clamper. Accordingly, the bonding can be performed with high precision. After bonding, the upper clamper is raised, and then the lower clamper is lowered. In other words, the lower clamper is lowered after the spring force of the upper clamper pressing against the tape has been released. Accordingly, there is no excessive force applied upon the tape, and no deformation occurs in the tape.

DETAILED DESCRIPTION OF THE INVENTION

One embodiment of the present invention will be described with reference to the accompanying drawings.

Figure 1:
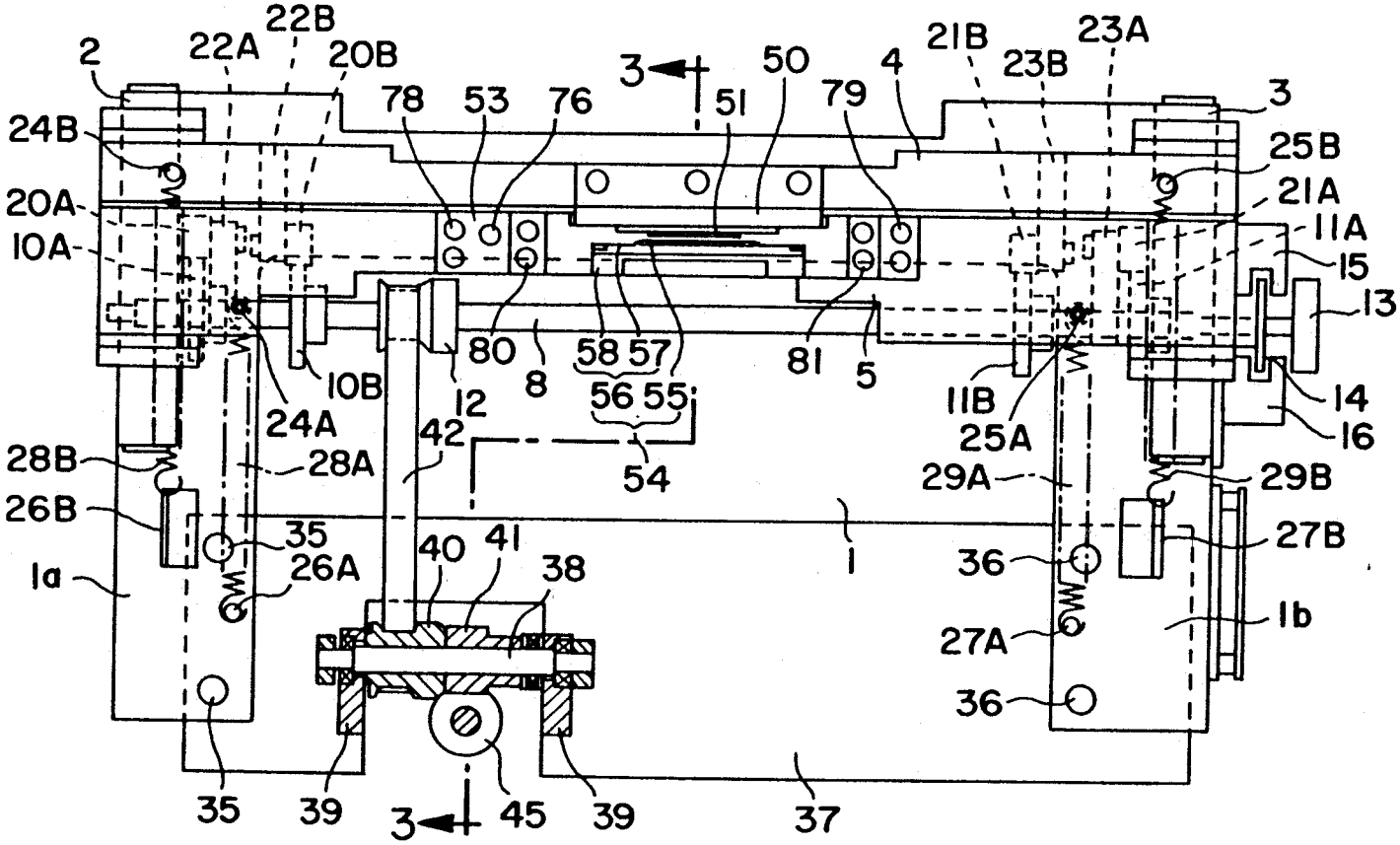
FIG. 1 is a partially cross-sectional front view of one embodiment of the present invention.
Figure 2:
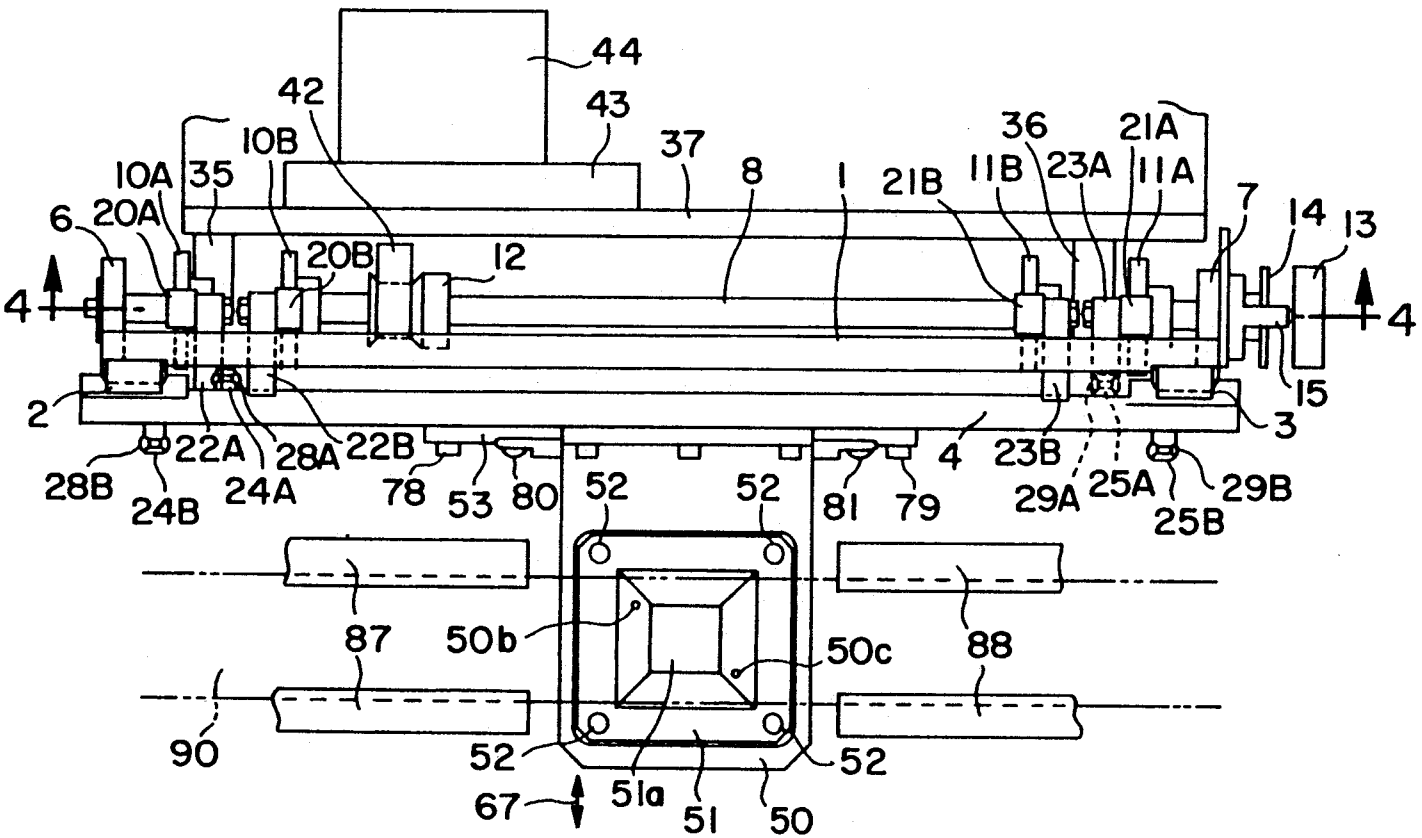
FIG. 2 is a top view thereof.

As shown in FIGS. 1 and 2, a supporting plate 1 of the tape feeding apparatus has two side plates 1*a* and 1*b* which extend downwardly, and raising-and-lowering cross roller guides 2 and 3 which are installed in an upright position are fastened to the side plates 1*a* and 1*b*, respectively.

An upper clamper supporting arm 4 and a lower clamper supporting arm 5 are respectively provided on the cross roller guides 2 and 3 so that the supporting arms 4 and 5 can move up and down along the cross roller guides 2 and 3. In addition, bearing holders 6 and 7 are fastened to the side plates 1*a* and 1*b* of the supporting plate 1, respectively, and a cam shaft 8 is supported between these bearing holders 6 and 7 in a rotatable fashion.

Figure 4:
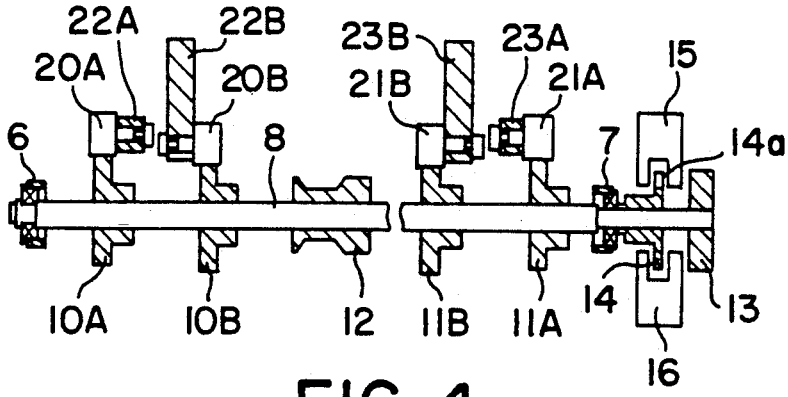
FIG. 4 is a cross section taken along the line 4—4 in FIG. 2.

As best shown in FIG. 4, lower clamper cams 10A and 11A are mounted on the cam shaft 8 at the left and right ends, respectively, and upper clamper cams 10B and 11B are also mounted on the cam shaft 8 so that they are between the lower clamper cams 10A and 11A. The cam shaft 8 is further provided with a pulley 12. The pulley 12 is between the upper clamper cams 10B and 11B. addition, a knob 13 is attached to one end (the right end in FIG. 4) of the cam shaft 8 so that the cam shaft 8 is rotatable manually via the knob 13.

A detection cam 14 is mounted to the cam shaft 8 on the inner side of the knob 13. The detection cam 14 has a starting-point groove 14*a* which is used as a mark of the start of rotation of the cam 14. Two photosensors 15 and 16 are mounted to the side plate 1*b* so as to face the detection cam 14 at positions 180 degrees apart.

Lower cam followers 20A and 21A are installed so as to face the upper surfaces of the lower clamper cams 10A and 11A, respectively; and upper cam followers 20B and 21B are respectively installed so as to face the upper surfaces of the upper clamper cams 10B and 11B.

Each of the cam followers 20A and 21A is rotatably supported on cam follower supporting arms 22A and 23A which are fastened to the lower clamper supporting arm 5. Also, each of the cam followers 20B and 21B is rotatably supported on cam follower supporting arms 22B and 23B which are fastened to the upper clamper supporting arm 4.

As best seen in FIG. 1, a spring 28A is mounted between an upper spring attachment pin 24A and a lower spring attachment pin 26A. Likewise, another spring 29A is mounted between an upper spring attachment pin 25A and a lower spring attachment pin 27A. The upper spring attachment pins 24A and 25A are secured to the lower clamper supporting arm 5, and the lower spring attachment pins 26A and 27A are secured to the side plates 1*a* and 1*b*. With these springs 28A and 29A, the cam followers 20A and 21A are pressed against the lower clamper cams 10A and 11A.

Similarly, a spring 28B is mounted between an upper spring attachment pin 24B and a spring attachment plate 26B. Likewise, another spring 29B is mounted between an upper spring attachment pin 25B and a spring attachment plate 27B. The upper spring attachment pins 24B and 25B are secured to the upper clamper supporting arm 4, and the spring attachment plates 26B and 27B are secured to the side plates 1*a* and 1*b*, respectively. With these springs 28B and 29B, the cam followers 20B and 21B are pressed against the upper clamper cams 10B and 11B.

Figure 3:
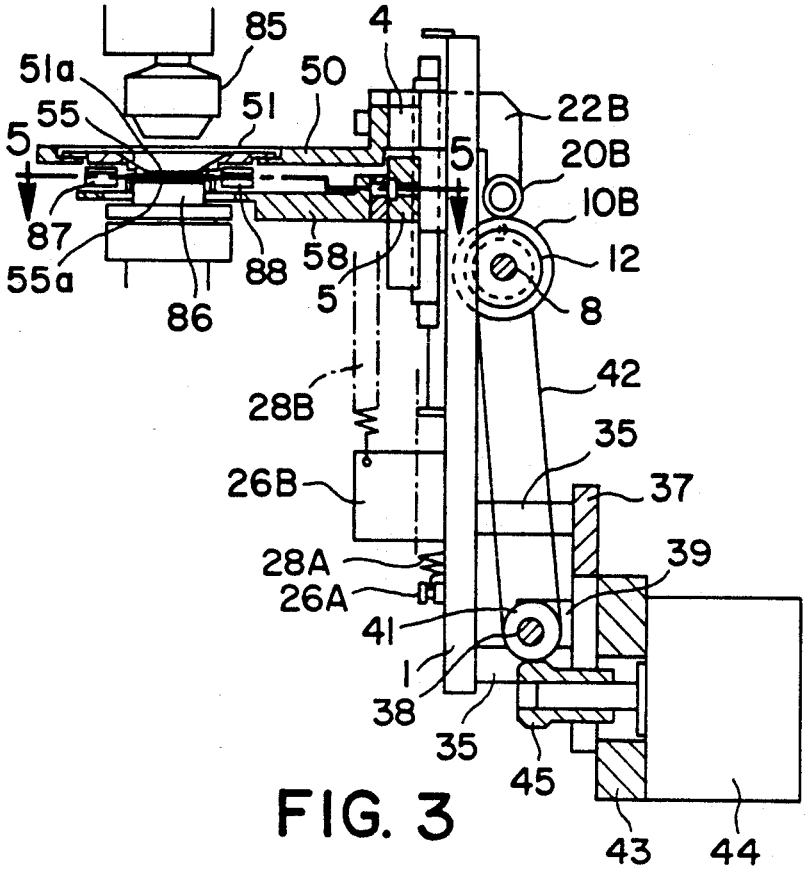
FIG. 3 is a cross section taken along the line 3—3 in FIG. 1.

The lower ends of the side plates 1*a* and 1*b* are fastened to a base plate 37 via supporting rods 35 and 36. Furthermore, a drive shaft 38 is installed parallel to the cam shaft 8 and beneath the pulley 12. This drive shaft 38 is rotatable between the two bearing holders 39 which are secured to the base plate 37. A pulley 40 and a worm wheel 41 are mounted on the drive shaft 38, and a belt 42 is mounted between the pulley 40 and the pulley 12. As seen in FIG. 3, a motor 44 is mounted to the base plate 37 via a motor support 43, and a worm gear 45 which engages with the worm wheel 41 is attached to the output shaft of the motor 44.

If the motor 44 is started, as seen from FIG. 1, the drive shaft 38 is rotated by the worm gear 45 and the worm wheel 41, and then the rotation of the drive shaft 38 is transmitted to the cam shaft 8 via the pulley 40, belt 42 and pulley 12.

When the cam shaft 8 is thus rotated, the lower cam followers 20A and 21A and the upper cam followers 20B and 21B are respectively raised and lowered according to the profiles of the lower clamper cams 10A and 11A and the upper clamper cams 10B and 11B. In other words, the lower clamper supporting arm 5 and upper clamper supporting arm 4 are raised and lowered along the cross roller guides 2 and 3.

In the present invention, the cams are formed so that when the cam shaft 8 undergoes a one half rotation, the lower clamper cams 10A and 11A use their rising profile, after which the upper clamper cams 10B and 11B use their dropping profile. Also, when the cam shaft 8 undergoes the remaining half rotation, the upper clamper cams 10B and 11B use their rising profile, after which the lower clamper cams 10A and 11A use their dropping profile.

As seen in FIG. 2, an upper clamper holding plate 50 is secured to the upper clamper holding arm 4, and an upper clamper 51 is mounted to this upper clamper holding plate 50 via screws 52. The upper clamper 51 has a bonding window 51*a* at the center.

Figure 5:
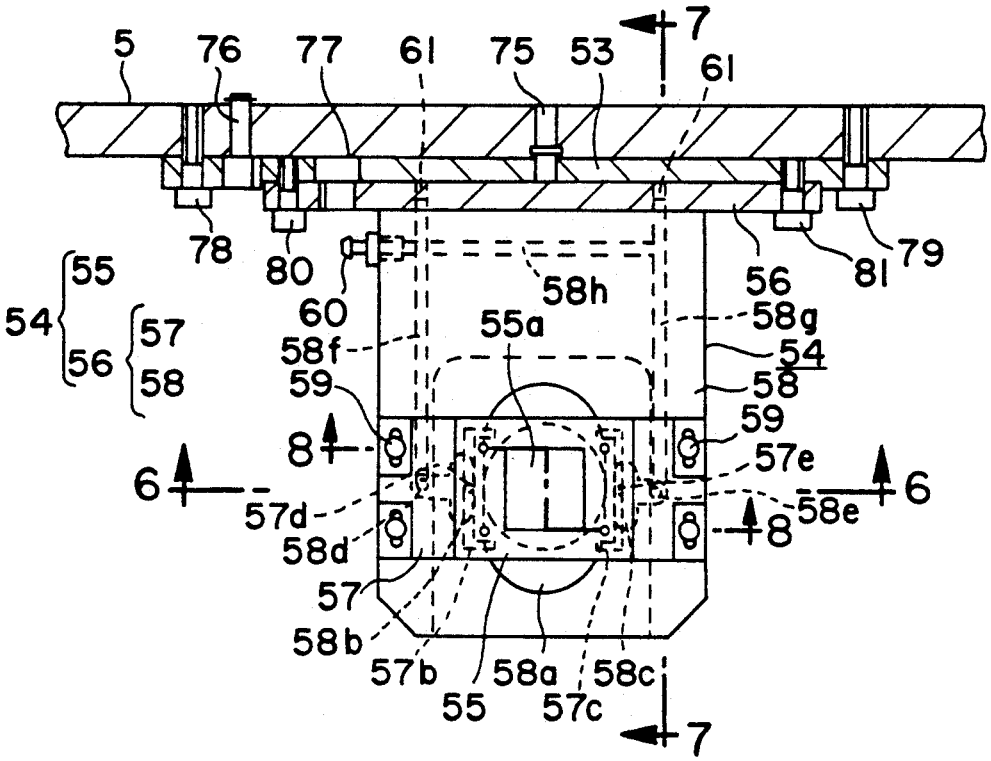
FIG. 5 is an enlarged cross section taken along the line 5—5 in FIG. 3.

Also, as seen in FIG. 5, the lower clamper supporting arm 5 is provided with a lower clamper 54 with a lower clamper adjustment plate 53 in between. As seen from FIG. 6, the lower clamper 54 consists of a lower clamper plate 55 and a lower clamper holder 56, and the lower clamper holder 56 is made up of an upper member 57 and a lower member 58 which are fastened together as a single unit by screws 59 (see FIG. 5).

The lower clamper plate 55 is approximately 0.3 to 0.5 mm in thickness and made of a metal which has minimal thermal deformation, such as an amber material, etc. The lower clamper plate 55 is provided with a bonding window 55*a*, which is approximately the same size as the bonding window 51*a* of the upper clamper 51 and at a position corresponding to the bonding window 51*a*.

The upper member 57 has an escape hole 57*a* at a position that corresponds to the bonding window 55*a* of the lower clamper plate 55. The lower member 58 has a central hole 58*a* at a position that corresponds to the escape hole 57*a* of the upper member 57.

Figure 11:
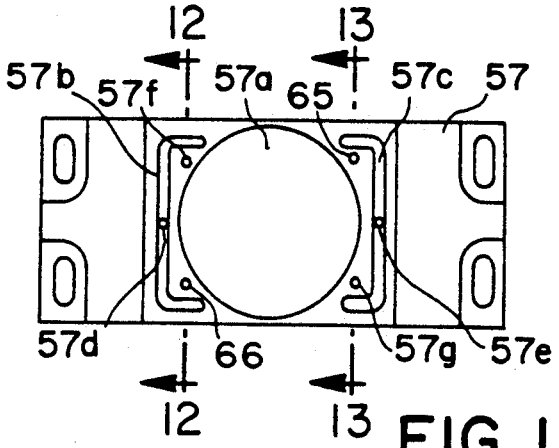
FIG. 11 is a top view of the upper member of the lower clamper holder.
Figure 12:
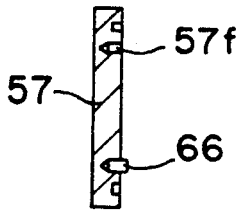
FIG. 12 is a cross section taken along the line 12—12 in FIG. 11.
Figure 13:
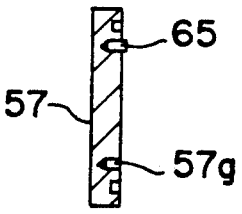
FIG. 13 is a cross section taken along the line 13—13 in FIG. 11.

As shown in FIG. 11, suction adhesion grooves 57*b* and 57*c* are formed, on the left and right, in the upper surface of the upper member 57. Suction adhesion holes 57*d* and 57*e* which pass through to the undersurface of the upper member 57 are formed in the suction adhesion grooves 57*b* and 57*c*.

Figure 9:
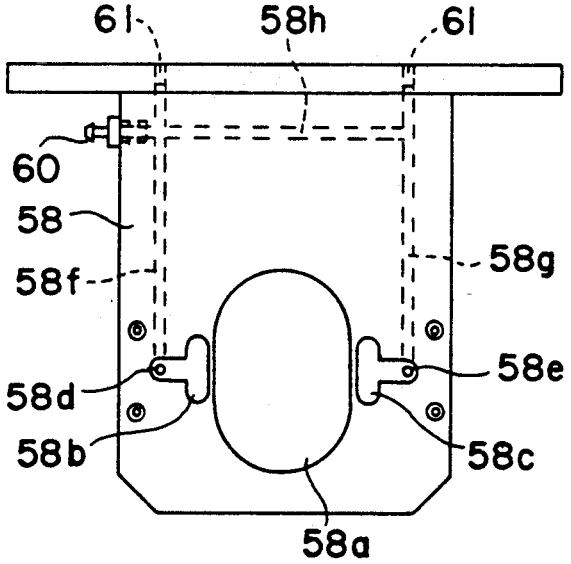
FIG. 9 is a top view of the lower member of a lower clamper holder used in the embodiment.

As shown in FIG. 9, suction ports 58*b* and 58*c* are formed in the lower member 58. These suction ports 58*b* and 58*c* positionally correspond to the suction adhesion holes 57*d* and 57*e* of the upper member, respectively, and suction adhesion holes 58*d* and 58*e* (made as blind holes) are formed in the suction ports 58*b* and 58*c*. These suction adhesion holes 58*d* and 58*e* connect, via suction adhesion paths 58*f*, 58*g* and 58*h* formed inside the lower member 58, with a pipe attachment fitting 60 which is installed on one side of the lower member 58. A pipe which is connected to a vacuum pump (not shown) is connected to the pipe attachment fitting 60. In FIG. 9, reference numeral 61 indicate sealing plugs.

As seen from the above, the pipe attachment fitting 60 connects with the suction adhesion holes 58*d* and 58*e* via the suction adhesion paths 58*f*, 58*g* and 58*h*, and the suction adhesion holes 58*d* and 58*e* connect with the suction adhesion holes 57*d* and 57*e* via the suction ports 58*b* and 58*c*, and then the suction adhesion holes 57*d* and 57*e* connect with the suction adhesion grooves 57*b* and 57*c*. Accordingly, when vacuum suction is applied to the pipe attachment fitting 60, the lower clamper plate 55 is held on the lower clamper holder 56 via the suction adhesion grooves 57*b* and 57*c* through vacuum suction adhesion supplied thereto.

Figure 10:
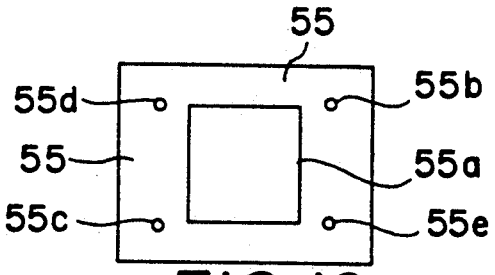
FIG. 10 is a top view of the lower clamper plate.

Furthermore, in order to position the lower clamper plate 55 on the upper member 57 of the lower clamper holder 56 (see FIG. 6), positioning pins 65 and 66 are installed vertically in the upper member 57 in two places across the escape hole 57*a* (see FIG. 11). As seen in FIG. 10, positioning hole 55*b* which fits over the positioning pin 65 and positioning slot 55*c* which fits over the positioning pin 66 are formed in the lower clamper plate 55. The positioning slot 55*c* extends in a direction in which the thermal expansion of the lower clamper holder 56 might occur. More specifically, since the lower clamper holder 56 is cantilever-fastened to the lower clamper supporting arm 5, the holder 56 tends to expand, as seen in FIG. 2, in the direction indicated by arrow 67. Thus, the positioning slot 55*c* is formed long in the direction of arrow 67.

Figure 8:
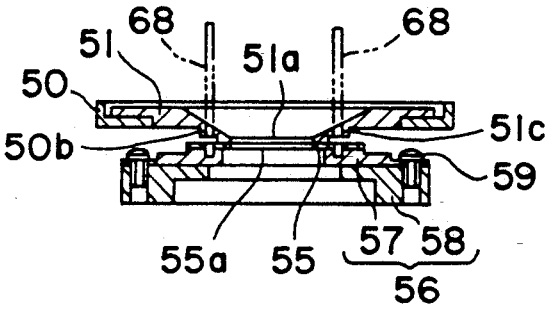
FIG. 8 is a cross section taken along the line 8—8 in FIG. 5.

Additionally, in order to position the upper clamper 51 relative to the lower clamper 54, as shown in FIGS. 10 and 11, two positioning holes 55*d* and 55*e* are formed in the lower clamper plate 55 of the lower clamper 54, and two positioning holes 57*f* and 57*g* are formed in the upper member 57. Also, two positioning holes 51*b* and 51*c* are formed (see FIG. 8) in the upper clamper 51 so that these holes 51*b* and 51*c* positionally correspond to the positioning holes 55*d* and 55*e* of the lower clamper plate 55 and the positioning holes 57*f* and 57*g* of the upper member 57. Accordingly, as shown in FIG. 8, by inserting positioning pins 68 into the positioning holes 55*d* and 55*e* of the lower clamper 54 via the positioning holes 51*b* and 51*c* of the upper clamper 51 after the screws 52 are loosened, and then by tightening back the screws 52, the upper clamper 51 is positioned relative to the lower clamper 54. This positioning adjustment of the upper clamper 51 is performed after the lower clamper 54 is positioned relative to the lower clamper supporting arm 5.

Figure 6:
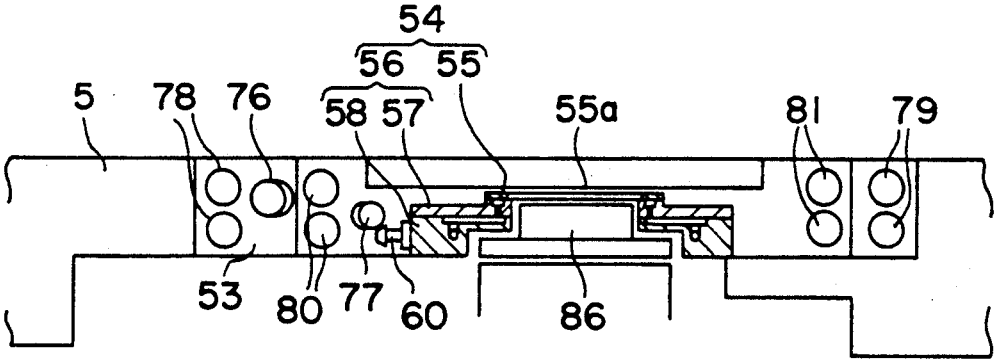
FIG. 6 is a cross section taken along the line 6—6 in FIG. 5.
Figure 7:
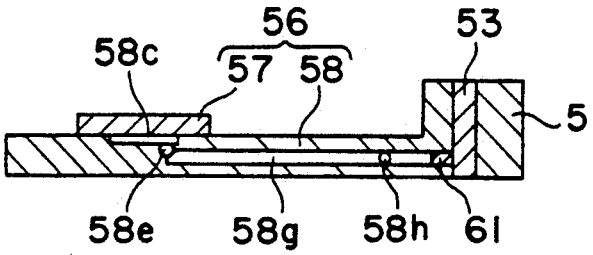
FIG. 7 is a cross section taken along the line 7—7 in FIG. 5.

As shown in FIGS. 5 and 6, a pin 75 is fastened to the lower clamper supporting arm 5, and the lower clamper adjustment plate 53 is fitted over the pin 75 in a rotatable manner. An eccentric pin 76 is rotatably fastened to the lower clamper supporting arm 5 so that the lower clamper adjustment plate 53 is fitted over the large-diameter portion of the eccentric pin 76. Moreover, the large-diameter portion of another eccentric pin 77 is inserted into the lower clamper adjustment plate 53, and the small-diameter portion of the eccentric pin 77 is inserted into the lower clamper holder 56 of the lower clamper 54. Furthermore, the lower clamper adjustment plate 53 is fastened to the lower clamper supporting arm 5 by screws 78 and 79, and the lower clamper holder 56 of the lower clamper 54 is fastened to the lower clamper adjustment plate 53 by screws 80 and 81.

Accordingly, any inclination of the lower clamper adjustment plate 53 can be adjusted by loosening the screws 78 and 79 and rotating the eccentric pin 76. Likewise, the position of the lower clamper 54 in the horizontal direction can be adjusted by loosening the screws 80 and 81 and rotating the eccentric pin 77.

As shown in FIG. 3, a bonding tool 85 which is driven in both vertical and horizontal directions by a driving means (not shown) is installed above the bonding window 51*a* of the upper clamper 51. A bonding stage 86 which is driven vertically and in a theta (0) direction is installed beneath the bonding window 55*a* of the lower clamper 54 so that a pellet (not shown) is placed on the bonding stage 86. Conveying rails 87 and 88 which guide a tab tape 90 (see FIG. 2) to the bonding windows 51*a* and 55*a* between the upper clamper 51 and the lower clamper plate 55 are installed on both sides of the upper clamper 51 and lower clamper 54.

Next, the operation will be described.

With the upper clamper 51 and lower clamper 54 separated from each other, i.e., with the upper clamper 51 in its raised position and the lower clamper 54 in its lowered position, the tab tape 90 is fed between the two clampers.

When the leadings provided on the tab tape 90 come in the area of the bonding windows 51*a* and 55*a*, and the pellet which is on the bonding stage 86 is aligned with the leads of the tab tape 90, the motor 44 is started.

When the motor is stated, the lower clamper cams 10A and 11A and the upper clamper cams 10B and 11B make a one half rotation together with the cam shaft 8. As a result, the lower clamper supporting arm 5 is first forcibly raised in accordance with the rising profile of the lower clamper cams 10A and 11*a*, resulting in that the lower clamper 54 is raised up to the tape feeding level of the tab tape 90. Then, the upper clamper supporting arm 4 is lowered by the force of the springs 28B and 29B in accordance with the dropping profile of the upper clamper cams 10B and 11B, so that the upper clamper 51 is lowered to the tape feeding level. The tab tape 90 is then clamped by the upper clamper 51 and lower clamper 54.

Next, the bonding stage 86 is raised by a driving means (not shown), so that the pellet on the bonding stage 86 approaches the tab tape 90. The bonding tool 85 is lowered to press the tab tape 90 against the pellet, and the pellet is bonded to the tab tape 90.

After the bonding is completed, the motor 44 is again rotated, which results in that the lower clamper cams 10A and 11A and the upper clamper cams 10B and 11B complete the remaining half rotation via the cam shaft 8. As a result, the upper clamper 51 is raised and thus withdrawn from the tape feeding path in accordance with the rising profile of the upper clamper cams 10B and 11B. The lower clamper 54 is then lowered and withdrawn from the tape feeding path in accordance with the dropping profile of the lower clamper cams 10A and 11A. Thus, the tab tape 90 is fed so that a next bonding portion of the tape is fed to the bonding windows 51*a* and 55*a*.

One operation is thus completed, and pellets are successively bonded to the tab tape 90 by repeating this operation.

In the embodiment described above, the lower clamper 54 has a complex structure. However, the present invention is applicable to a lower clamper of a simple structure. More specifically, the lower clamper 54 could be of such a generally known structure as that of a lower clamper plate and a lower clamper holder made in a single unit, without using any vacuum suction adhesion. In addition, the upper clamper supporting arm 4 and the upper clamper holding plate 50 could also be formed as a single unit.

Since the upper clamper 51 and the lower clamper 54 are both driven in a vertical direction, the upper and lower clampers 51 and 54, which clamp the tape 90 in between, can be withdrawn from the tape feeding path during the tape feeding operation. More specifically, the upper clamper 51 is raised and the lower clamper 54 is lowered. As a result, both the upper and under surfaces of the tape 90 do not contact the upper clamper 51 nor the lower clamper 54 when the tape is being fed. Accordingly, scratches, etc., in the tape 90 is prevented.

In addition, since the upper clamper 51 and the lower clamper 54 are driven by a single driving source (the motor 44 and the cam shaft 8), the number of driving parts, etc. used to drive the upper and lower clampers 51 and 54 is small. Thus, the manufacturing costs of the tape feeding apparatus can be low.

Furthermore, in the present invention, during the tape clamping operation, the lower clamper 54 is forcibly raised by the cams 10A, 11A, 10B and 11B, thus determining the bonding level of the tape 90. Afterward, the upper clamper 51 is lowered so that the tape 90 is pressed against the lower clamper 54 by the force of the springs 28A, 28B, 29A and 29B. Thus, the bonding level of the tape 90 is determined with reference to the upper surface of the lower clamper 54, and therefore, the bonding precision can be high. When the bonding is completed, the lower clamper 54 is lowered after the upper clamper 51 has been raised. In other words, the lower clamper 54 is lowered after the force of the springs 28A, 28B, 29A and 29B by which the upper clamper 51 presses against the tape 90 has been released. Accordingly, no excessive force is applied to the tape 90, and deformation of the tape is avoidable.

I claim:

1. A clamping mechanism for a tape bonding machine used in semiconductor processing, said clamping mechanism comprising an upper clamper and a lower clamper for holding said tape and wherein:

said upper clamper and said lower clamper are both driven upward and downward, respectively;

said upper clamper and said lower clamper are driven by a single driving source;

said upper clamper and said lower clamper are forcibly raised by cams and lowered by spring means; and control means for controlling said upper clamper and lower clamper during a tape clamping operation so that said upper clamper is lowered after said lower clamper has been raised, and during tape feeding operations, so that said lower clamper is lowered after said upper clamper has been raised.

* * * * *